US005709342A

United States Patent [19]

McCauley

[11] Patent Number: 5,709,342

[45] Date of Patent: Jan. 20, 1998

[54] VENTED ARMATURE/VALVE ASSEMBLY AND FUEL INJECTOR UTILIZING SAME

[75] Inventor: David B. McCauley, Indianapolis, Ind.

[73] Assignee: Caterpillar Inc., Peoria, Ill.

[21] Appl. No.: 555,735

[22] Filed: Nov. 9, 1995

[51] Int. Cl.[6] ..... B05B 1/30

[52] U.S. Cl. ..... 239/585.5; 239/585.1; 137/625.65

[58] Field of Search ..... 239/585.1–585.5; 137/625.65

[56] References Cited

U.S. PATENT DOCUMENTS

| | | | |
|---|---|---|---|
| 2,332,909 | 10/1943 | Fuscaldo | 137/139 |
| 3,053,463 | 9/1962 | Milleville | 239/584 |
| 4,060,199 | 11/1977 | Brune et al. | 239/488 |
| 4,197,996 | 4/1980 | Giardini | 239/87 |
| 4,280,661 | 7/1981 | Tanasawa et al. | 239/409 |
| 4,360,163 | 11/1982 | Williams | 137/625.65 X |
| 4,384,681 | 5/1983 | Claxton | 239/585 |
| 4,485,969 | 12/1984 | Deckard et al. | 239/585.1 X |
| 4,618,095 | 10/1986 | Spoolstra | 239/585.1 X |
| 4,899,699 | 2/1990 | Huang et al. | 123/73 |
| 5,072,885 | 12/1991 | Hans et al. | 239/466 |
| 5,271,371 | 12/1993 | Meints et al. | 123/446 |
| 5,314,122 | 5/1994 | Winter | 239/585.1 |
| 5,421,521 | 6/1995 | Gibson et al. | 239/585.4 |

*Primary Examiner*—Andres Kashnikow
*Assistant Examiner*—Steven J. Ganey
*Attorney, Agent, or Firm*—Liell & McNeil

[57] ABSTRACT

A vented solenoid armature/valve member assembly comprises an armature joined to a valve member by a vented screw. The screw includes a vent hole extending its complete length in order to accommodate fluid displacement that occurs when the armature/valve member assembly is moved by energizing the solenoid. By providing venting through the screw itself, several advantages are achieved including the elimination of vent holes in the valve member as well as the ability to use a relatively larger screw to hold the armature and valve member together. This in turn results in a more robust armature/valve member assembly. The present invention finds particular application in hydraulically actuated electronically controlled fuel injectors in which initiation of injection events is controlled by a solenoid actuated valve.

20 Claims, 6 Drawing Sheets

VENTED ARMATURE/VALVE ASSEMBLY AND FUEL INJECTOR UTILIZING SAME

TECHNICAL FIELD

The present invention relates generally to vented armature/valve member assemblies, and in particular to such an assembly using a vented screw in a fuel injector.

BACKGROUND ART

In many solenoid actuated valve applications, particularly those relating to fuel injectors, fluid around the armature/valve member assembly must be displaced when the valve is actuated by the solenoid. In many such applications, it is usually not feasible to produce a single solid machined part which can act as both the armature and the valve member because of the different requirements on the armature and the valve member. In particular, in the case of fuel injectors, the armature must have the ability to maximize the magnetic force, have a relatively low ability to retain magnetism and have a cost appropriate to the armatures near net shape requirements. On the other hand, the valve member must exhibit relatively extreme hardenability while being able to be extruded or machined at a cost appropriate to its near net shape. Thus, because of the differing demands on the valve member and the armature, they typically must be manufactured from different materials and joined by a fastener, such as a screw. In prior art armature/valve member assemblies, vent holes must typically be machined in both the armature and the valve member in order to allow fluid to be displaced when the valve member is actuated by the solenoid.

It is usually desirable that the armature and valve member behave as a single solid part. This in turn requires that the screw connecting the armature to the valve member be as large as possible in order to make the strongest possible joinder of the armature to the valve member. Unfortunately, this requirement often conflicts with the need to provide vent holes for the displacement of fluid when the solenoid is actuated. The need for vent holes often limits the size of the available screw that can be utilized. The need to provide vent holes in the valve member is also undesirable because of the additional machining costs as well as other factors including maximizing reference surface areas for machining highly precisioned valve seats on the outer surface of the valve member.

In the case of prior art hydraulically actuated electronically controlled fuel injectors (HEUI) such as those manufactured by Caterpillar, the armature/valve member assembly that controls the supply of high pressure actuation fluid is assembled with a solid screw. In these prior art devices both the armature and the valve member include vent holes which accommodate the displacement of fluid when the solenoid is actuated. It is believed that one of the main causes of failure in HEUI type injectors is due to the fact that a relatively weak screw must be utilized to join the armature to the valve member because of the necessity to include vent holes in the valve member. The present invention is directed to overcoming the apparent conflicting demands of valve member venting and strength of the screw joining the armature to the valve member, and to addressing other problems related to armature/valve member assemblies, particularly those related to fuel injectors.

DISCLOSURE OF THE INVENTION

In one embodiment of the present invention, a vented solenoid armature/valve member assembly comprises an armature attached to a valve member with a vented screw. The armature has an upper surface, a lower surface, and a screw hole extending through the upper surface and the lower surface. The valve member has an axis, a first end, a second end, an outer surface extending between the first end and the second end, a threaded hole extending through the first end along the axis, an opening through the second surface and a hollow interior that opens to the threaded hole and the opening. The vented screw has the same axis, a head and a rod portion aligned with the axis attached to the head and a vent hole extending through the rod portion and the head along the axis. The rod portion has threads that fit the threaded hole of the valve member. The vented screw extends through the screw hole of the armature and is threaded into the threaded hole of the valve member. By accomplishing venting through the screw itself, venting holes can be eliminated in the valve member and the joining screw can be made significantly larger than prior art assemblies. Thus, the machining and associated costs necessary to provide vent holes in the valve member are eliminated, while at the same time the connection between the armature and the valve member is made significantly more robust.

In another embodiment of the present invention a hydraulically actuated fuel injector incorporates a vented solenoid armature/valve member assembly as the means by which hydraulic actuation fluid is supplied to the intensifier piston of the injector. The injector includes an injector body having various cavities and passageways, an intensifier piston, a plunger, a needle check valve and a solenoid that controls the valve member. When the solenoid is activated or deactivated, the armature causes the valve member to move from a first position to a second position. In the first position, the actuation fluid inlet is open, whereas in the second position the actuation fluid drain is open. When the actuation fluid inlet is open, high pressure hydraulic actuation fluid flows into the injector body causing the intensifier piston to begin its downward movement which in turn begins the downward movement of the plunger. As pressure builds within the fuel pressurization chamber, the needle check valve opens and allows fuel to exit the injector through the nozzle outlet. The armature and the valve member are attached to one another via a vented screw that permits fluid displacement around and through the armature/valve member assembly when the activation state of the solenoid is changed.

One object of the present invention is to extend the life of HEUI type fuel injectors.

Another object of the present invention is to increase robustness in vented armature/valve member assemblies.

Still another object of the present invention is to eliminate relatively expensive machining operations from the manufacture of valve members.

Another object of the present invention is to improve the ability to machine highly sensitive valve seats on the outer surface of valve members.

Still another object of the present invention is to provide vented armatures out of weaker and less expensive materials.

Another object of the present invention is to provide improved vented armatures/valve member assemblies.

BEST MODE FOR CARRYING OUT THE INVENTION

Figure 1:
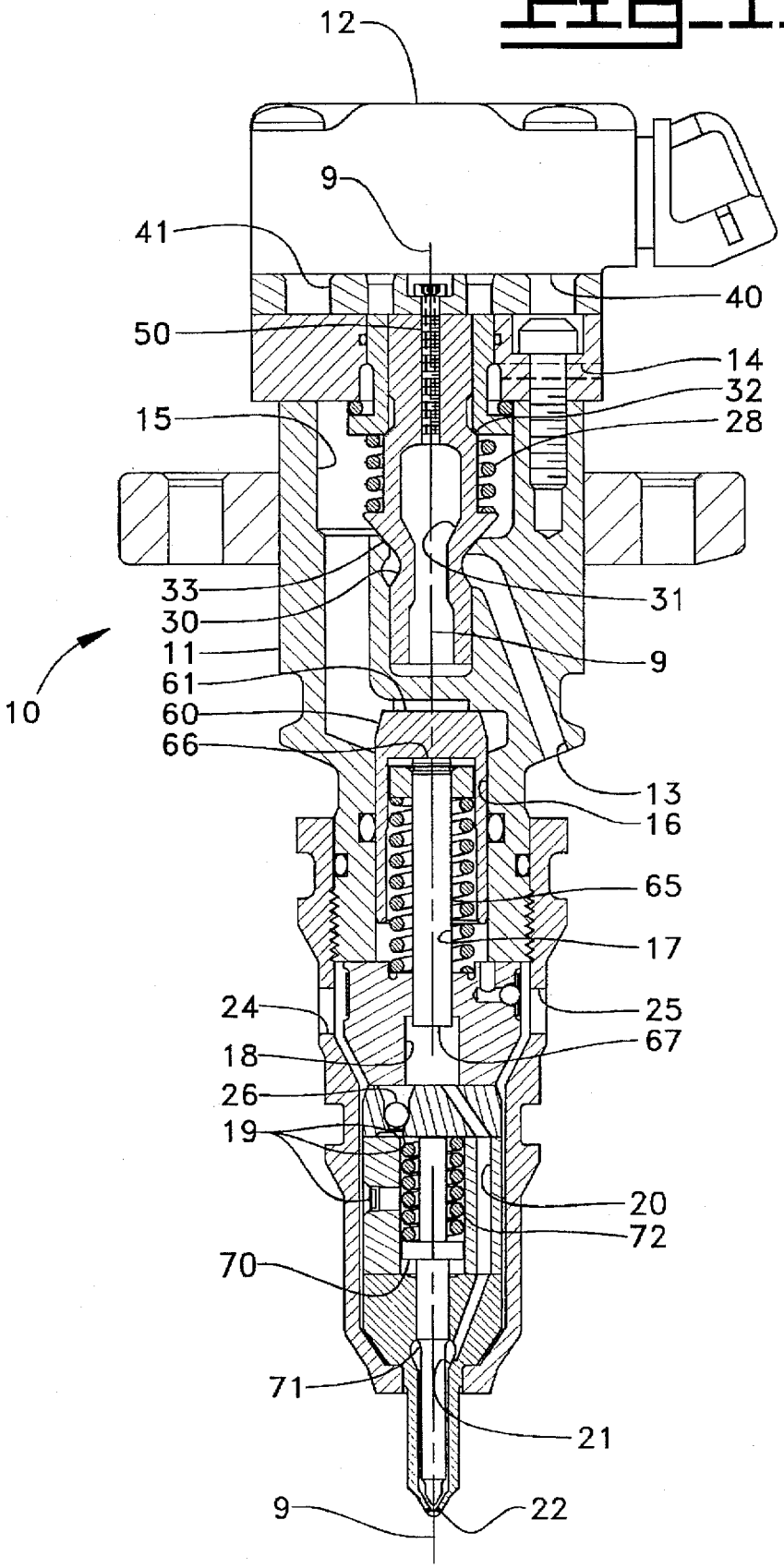
FIG. 1 is a side sectioned elevational view of a HEUI type fuel injector according to one embodiment of the present invention.

Referring now to FIG. 1, a hydraulically actuated electronically controlled fuel injector 10 is structurally similar to prior art injectors of its type except for the inclusion of a vented screw 50 for joining valve member 30 to armature 41. Most of the key components of injector 10 are centered around an axis 9. Although those skilled in the art have learned from prior references the various components and functioning of the injector 10, a brief review of injector 10's internal structure will aid those skilled in the art in appreciating the advantages of the present invention, at least as it relates to hydraulically actuated fuel injectors.

Injector 10 includes an injector body 11 made from several joined blocks machined with various internal passageways in a manner known in the art. In particular, the injector body 11 includes an actuation fluid cavity 15 that opens to an actuation fluid inlet 13, an actuation fluid drain 14 (hidden in this sectioned view) and a piston bore 16. The injector body also defines a plunger bore 17 that opens to a nozzle supply bore 20 and a fuel supply passage 19. Finally, the injector body defines a nozzle chamber 21 that opens to nozzle supply bore 20 and a nozzle outlet 22. An intensifier piston 60 is positioned to reciprocate in piston bore 16 between an upper position (as shown) and a lower position. A plunger 65 having a contact end 66 and pressure face end 67 is positioned to reciprocate in plunger bore 17 between an advanced position and a return position (as shown). A portion of the plunger bore and the pressure face end 67 of the plunger define a fuel pressurization chamber 18. A one way valve 26 is positioned in the fuel supply passage 19 and is operable to prevent fluid flow from fuel pressurization chamber 18 into fuel supply passage 19.

A needle check 70 is positioned to reciprocate in nozzle chamber 21 between a closed position that closes nozzle outlet 22 and an open position that opens the nozzle outlet. The needle check includes a hydraulic lift surface 71 exposed to nozzle chamber 21 and means, such as coil spring 72, for biasing the needle check 70 towards its closed position. A solenoid housing 12 is attached to the top of injector body 11 and includes an electromagnetic coil (not shown) and an armature 41 that moves when the electromagnetic coil is activated with electric current. Armature 41 is connected to a valve member 30 via a vented screw 50 so that valve member 30 moves with armature 41 in order to open and close actuation fluid inlet 13 and actuation fluid drain 14. In this embodiment, return spring 28 biases valve member 30 and armature 41 to a lower position in which valve seat 33 closes actuation fluid inlet 13 when the solenoid is deactivated.

An injection event is initiated by energizing the solenoid to lift valve member 30 off its lower seat so that high pressure hydraulic actuation fluid flows into actuation fluid cavity 15. The high pressure hydraulic actuation fluid in cavity 15 acts on the top surface 61 of intensifier piston 60 and begins pushing the intensifier piston toward its lower position. Movement of intensifier piston 60 simultaneously causes plunger 65 to move downward towards its advanced position because of the contact between the piston and the plunger. Downward movement of plunger 65 in turn raises fuel pressure within fuel pressurization chamber 18. When fuel pressure in pressurization chamber 18, nozzle supply passage 20 and nozzle chamber 21 reaches a threshold pressure sufficient to overcome biasing spring 72, needle check 70 lifts and nozzle outlet 22 is opened. In this embodiment, each injection event ends by deenergizing the solenoid to close actuation fluid inlet 13, which simultaneously opens actuation fluid cavity 15 to the low pressure actuation fluid drain 14. Those skilled in the art will appreciate that other means could be provided for ending each injection event other than by de-energizing the solenoid, such as by providing a spill port in the plunger and/or allowing injection to continue until the plunger reaches the end of its stroke. In between injection events, fuel flows into injector body 11 through fuel inlet 24 along fuel supply passage 19 past one way valve 26 and into fuel pressurization chamber 18 as plunger 65 and piston 60 retract in preparation for the next injection event. Fuel entering inlet 24 is free to circulate to fuel outlet 25 so that various injectors for a multi cylinder engine can be connected serially to a fuel supply source in a manner known in the art.

The plunger and piston are able to retract between injection events because actuation fluid in actuation fluid cavity 15 is allowed to escape through to a low pressure actuation fluid drain 14 because the passage past upper valve seat 32 of valve member 30 is open when the solenoid is de-energized. When the solenoid is energized, armature 41 and valve member 30 are lifted a distance on the order of about 250 microns which is sufficient to close the low pressure actuation fluid drain 14 while simultaneously opening the high pressure actuation fluid inlet 13 to cavity 15.

When armature 41 and valve member 30 are lifted by energizing the solenoid, the fluid circulating around these components must be displaced. Thus, in order to prevent this fluid displacement from interfering with the movement of the armature/valve member assembly, some means must be provided for venting the displaced fluid through the assembly. Because of the extreme sensitivity of the valve seats on the valve member and the relatively short distance that the valve member travels between positions it is required that the armature 41 and the valve member 30 behave as a single solid piece. This in turn requires that connecting screw 50 be as strong as possible, in order to hold the two pieces together in a rigid manner. In prior art devices, the requirement of vent holes in the valve member limited the size of the joining screw such that the connection between armature 41 and valve member 30 was relatively weak. The present invention adds robustness to this connection by eliminating the vent holes in the valve member and instead incorporating a vent hole down the center of the joining screw 50 in order to permit displacement of fluids from above armature 41 into the hollow interior 31 of valve member 30. By incorporating the vent hole into the joining screw itself, and by eliminating the vent holes in the valve member, the joining screw can be made significantly larger. Thus, the connection between the armature 41 and valve member 30 can be made significantly more robust.

Figure 2:
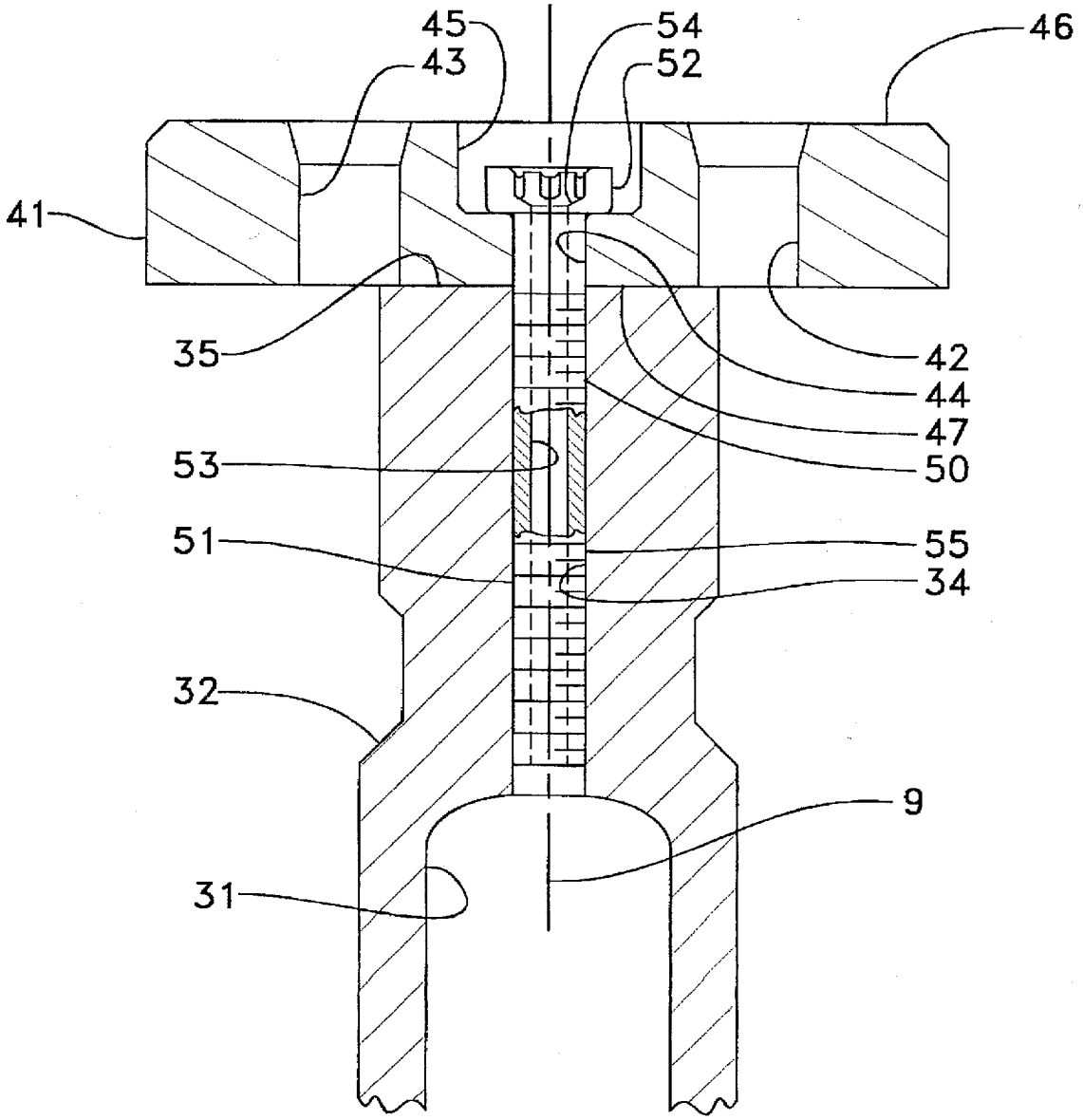
FIG. 2 is an enlarged side sectional view of the vented armature/valve member assembly of the fuel injector shown in FIG. 1.
Figure 3A:
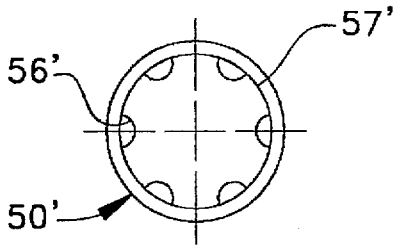
Fig 3a (PRIOR ART)
FIGS. 3*a* and 3*b* are end and side elevational views, respectively, of a armature/valve member joining screw according to the prior art.

Referring now to FIG. 2, an enlarged view of the armature/valve member assembly of the injector 10 of FIG. 1 is illustrated. Armature 41 includes an upper surface 46, a lower surface 47 and a screw hole 44 extending between the upper and lower surfaces. A portion of screw hole 44 is a counter-bore 45 sized to receive the head 52 of vented screw 50. Preferably, the counter-bore 45 is of sufficient size to completely receive head 52 so that no portion of the head extends above upper surface 46 of armature 41 in a way that could interfere with the movement of the armature. In other words, it is desirable that head 52 of vented screw 50 not come into contact with any surfaces when the armature/valve member assembly is moving between its positions. Armature 41 also includes a pair of vent holes 42 and 43 through which some fluid is displaced when the armature is moved by energizing the solenoid.

Vented screw 50 includes a threaded rod portion 51 connected to head 52. A vent hole 53 runs the length of the vented screw 50 along axis 9. Threads 55 on rod portion 51 are intended to fit threads of threaded opening 34 in the top portion of valve member 30. This permits vented screw 50 to securely hold lower surface 47 of armature 41 in contact with top end 35 of valve member 30. In the past, the relatively smaller joining screw could only be torqued up to about 2.3 Newton-meters, whereas the more robust vented screw 50 of the present invention can be torqued up in excess of about 3 Newton-meters, which provides a significantly more robust connection between the armature and the valve member. The vent hole 53 invented screw 50 permits a portion of the fluid displaced by the assemblies movement to travel between the hollow interior 31 of valve member 30 and the upper surface 46 of armature 41.

Referring now to FIGS. 3*a*–8*b*, the various components of the armature/valve member assembly for both prior art devices and the present invention are compared side by side. The need to include vent holes in the prior art valve member limited the size of the available screw that could be used to hold the armature to the valve member. Prior art screw 50' in turn resulted in a screw with a head 57' having an outer drive surface 56' The requirement for an outer drive in turn resulted in a relatively weaker connection between the armature and the valve member because the holding power of the screw is related at least in part to the available surface area on the underside of the head available for contact with the armature. An outer drive renders the outer periphery of the screw relatively weak for the simple reason that less material was available on the outer peripheral edge of head 57'. An internally driven version of this screw was not practically available because of the extremely small size driving tool that would be required to rotate the screw when fastening the armature to the valve member. Furthermore, the presence of vent holes in the valve member also required that the rod portion 51' of the screw have a relatively small diameter which further limited the amount of torque that could be carried by the screw. Prior art screw 50' also included threads 55' on its rod portion 51' that fit corresponding threads in the prior art valve member. The constraints of the prior art resulted in a screw 50' with a head having a diameter on the order of about 5.25 millimeters and a rod portion with M3X0.5-4g6g threads and a relatively small diameter.

Figure 4A:
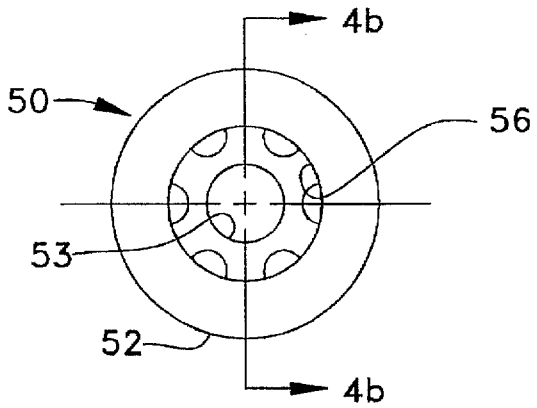
FIGS. 4*a* and 4*b* are end and side elevational views, respectively, of a vented armature/valve member screw according to one aspect of the present invention.
Figure 3B:
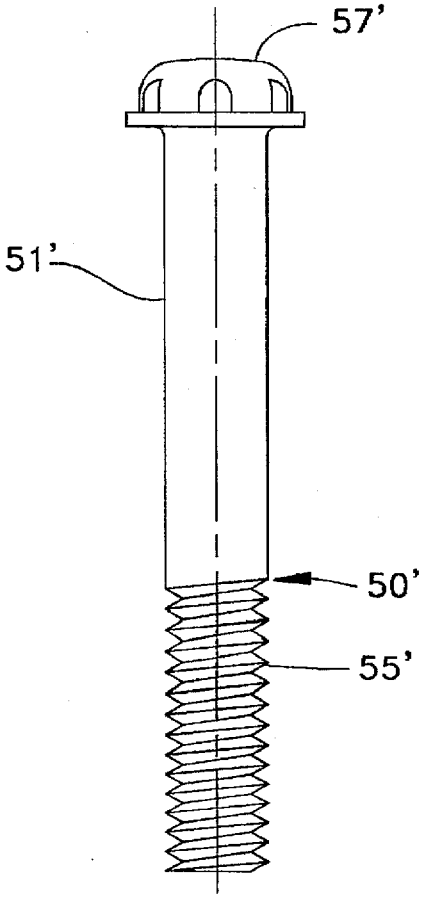
Fig 3b (PRIOR ART)
Figure 4B:
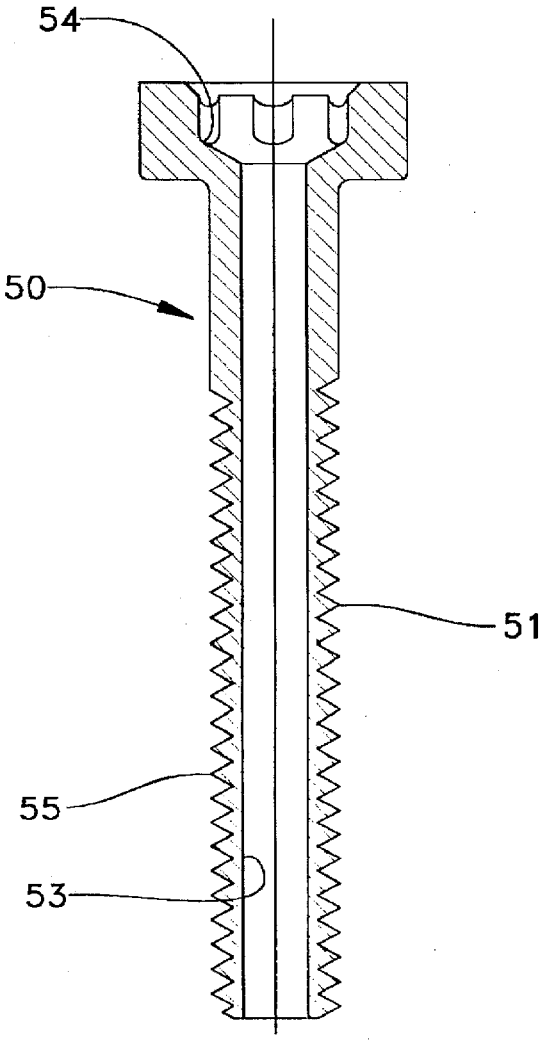

Referring now to FIGS. 4A and 4B, by incorporating venting into a vent hole 53 within the vented screw 50 instead of providing vent holes in the valve member, the vented screw of the present invention can be made significantly larger and more robust than the prior art. In particular, the head of the vented screw 50 can be made on the order of about 6.3 millimeters in diameter, the rod portion can be enlarged in excess of 15% in diameter and having M4X0.7-4g6g threads. This increased sized head in turn allowed for providing an internal line drive shape 56 as part of the vent hole 53. The use of an internal drive in turn beefed up the outer periphery of the head portion which provides a large portion of the holding power in contact with the corresponding surface on the armature.

It is important to note that the vent hole 53 through the vented screw 50 must have a sufficient cross sectional area to accommodate the fluid displacement that would otherwise occur in the vent holes made in the prior art valve member. In this case, the vent hole through the screw is on the order of about 1.8 millimeters. The elimination of venting holes in the valve member also permits for a significantly larger diameter for the rod portion 51 of the screw. This in turn affords increased holding ability and added strength to the connection between the armature and the valve member. As in the prior art, the rod portion 51 includes external threads 55 which match those in the corresponding valve member of the present invention. In both the present invention and the prior art, the screws are preferably made from extruded steel 1E1725. In the prior art, the relative small size of the screw could limit its ability to be torqued up beyond about 2.3 Newton-meters, whereas the vented screw of the present invention can be torqued up in excess of 3 Newton-meters and often as high as 3.5 Newton-meters or more. Torquing either screw up beyond its limits results in it stretching beyond its elastic range when joining the armature to the valve member. In other words, the stretch of the rod portions of the screws must be within the elastic range of the screw in order to provide the type of rigid connection between the armature and the valve member required in order for them to behave as a single solid piece.

Figure 5A:
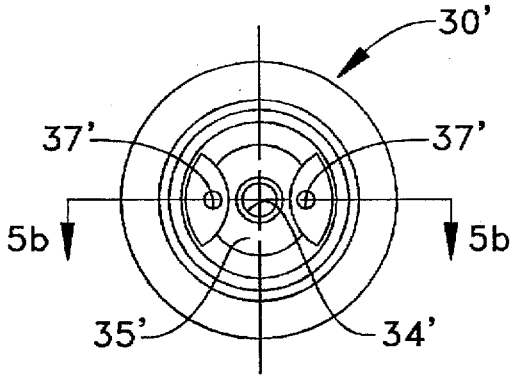
Fig 5a (PRIOR ART)
FIGS. 5*a* and 5*b* are end and side sectioned elevational views, respectively, of a valve member according to the prior art.
Figure 5B:
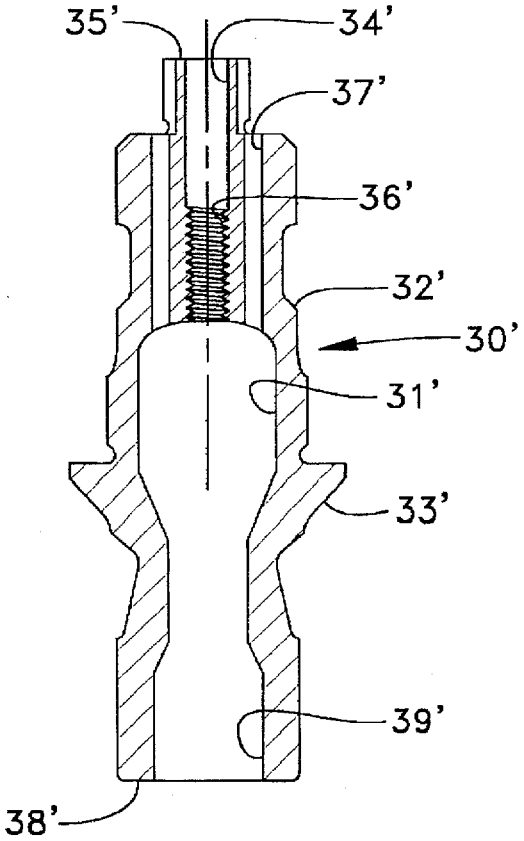
Fig 5b (PRIOR ART)

Referring now to FIGS. 5*a* and 5*b*, a prior art valve member 30' is illustrated. The valve member includes a top planer locating surface 35' which is separated from the bottom end 38' by an outer surface that includes valve seats 32' and 33'. The valve member includes a hollow interior 31' that opens to bottom end 38' via opening 39' and through the top surface 35' via a threaded hole 34. The valve member is made hollow in order to decrease its inertia and hasten the movement rate of the valve member assembly. Portions of the outer surface of the valve member adjacent top end 35' are concave in order to accommodate vent holes 37' which open into the hollow interior of the valve member and permit fluid displacement when the valve member is actuated. Threads 36' and threaded hole 34' are designed to match those on the outer surface of the prior art screw 50'.

Figure 6A:
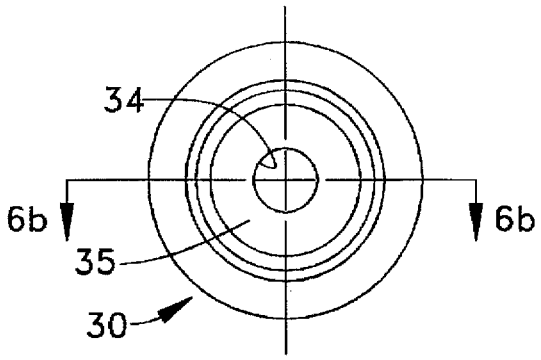
FIGS. 6*a* and 6*b* are end and side sectioned elevational views of a valve member according to one aspect of the present invention.
Figure 6B:
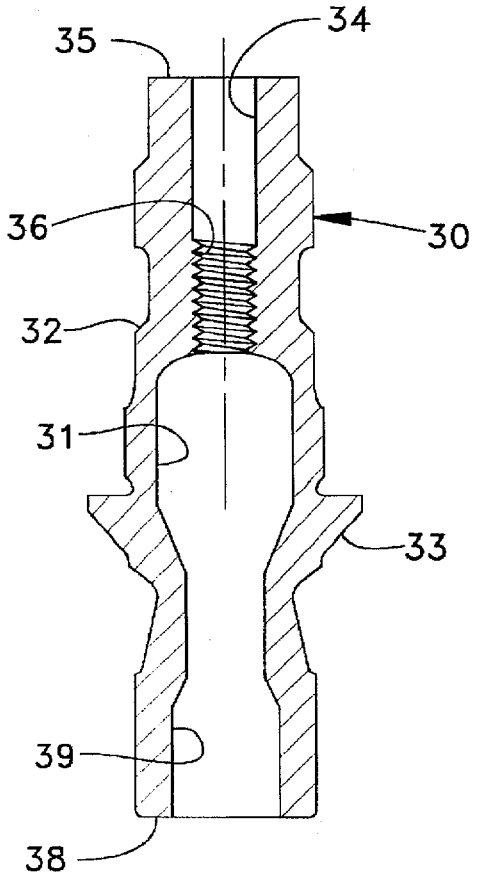
Figure 7A:
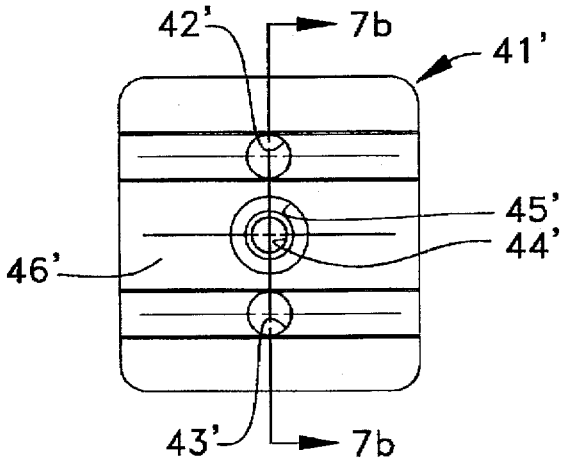
Fig. 7a (PRIOR ART)
FIGS. 7*a* and 7*b* are top and side sectioned elevational views, respectively, of an armature according to the prior art.
Figure 8A:
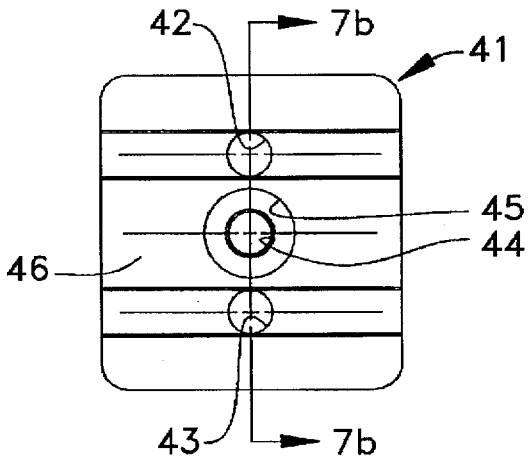
FIGS. 8*a* and 8*b* are top and side sectioned elevational views, respectively, of an armature according to one aspect of the present invention.
Figure 7B:
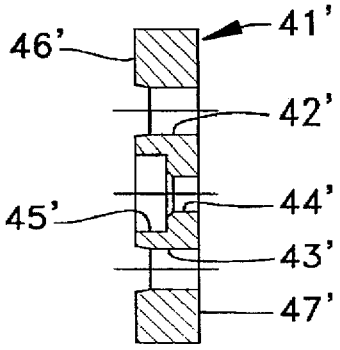
Fig. 7b (PRIOR ART)
Figure 8B:
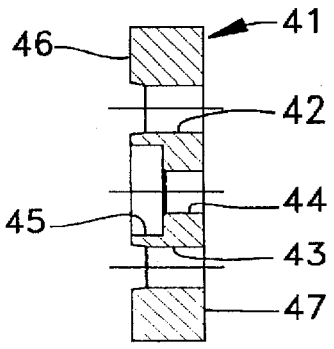

Referring now to FIG. 6*a* and 6*b*, a valve member according to the present invention is illustrated. This valve member has a very similar outside surface to that of the prior art valve member in that it includes substantially identical valve seats 33 and 32. However, the threaded hole through top end 35 is significantly larger in order to accommodate the relatively larger vented screw of the present invention. As can be seen, the top planer locating surface 35 can be made relatively larger because of the elimination of the vent holes 37' of the prior art design. Like the previous design, the valve member has a hollow interior 31 that opens through bottom end 38 through an opening 39 and through the top end 35 through threaded opening 34, which includes threads 36 that match those of the vented screw 50 of the present invention. An additional advantage of the present invention flows from the fact that the top planer surface 35 is relatively larger in area than the prior art which permits the valve seats 32 and 33 to be machined with greater reliability and accuracy. The valve member 30 of the present invention is also significantly easier and cheaper to manufacture because there is no need to machine the vent holes into the valve member, nor a necessity to do other machining tasks such as deburring the vent holes, etc.

Referring now to FIGS. *7a* and *7b*, a prior art armature 41' is shown to include vent holes 42' and 43', a screw hole 44' extending through the upper surface 46' and a lower surface 47'. The screw hole 44' includes a counter-bore 45' that is sized to receive the head of the prior art screw 50' therein. Because of the limited available contact surface available on the underside of the head of prior art screw 50', the prior art armature 41' had to be made from wrought iron rather than a less expensive alternative such as powdered metal. In other words, if a powdered metal armature were utilized in the prior art design, the armature would tend to crumble when the screw was torqued up to its required magnitude. The armature 41 of the present invention, on the other hand, can be made from powdered metal because the vented screw has a significantly larger contact surface on the underside of the head so that crumbling problems can be avoided. Because of the lower density of powdered metal, the armature 41 of the present invention appears thicker but actually has a mass on the same order as that of the prior art armature 41' so that no significant amount inertia is added. Like the prior art armature, the armature 41 of the present invention includes vent holes 42 and 43 as well as a screw hole 44 that includes a counter-bore portion 45. The screw hole 44 extends through the upper surface 46 of the armature and the lower surface 47.

Figure 9:
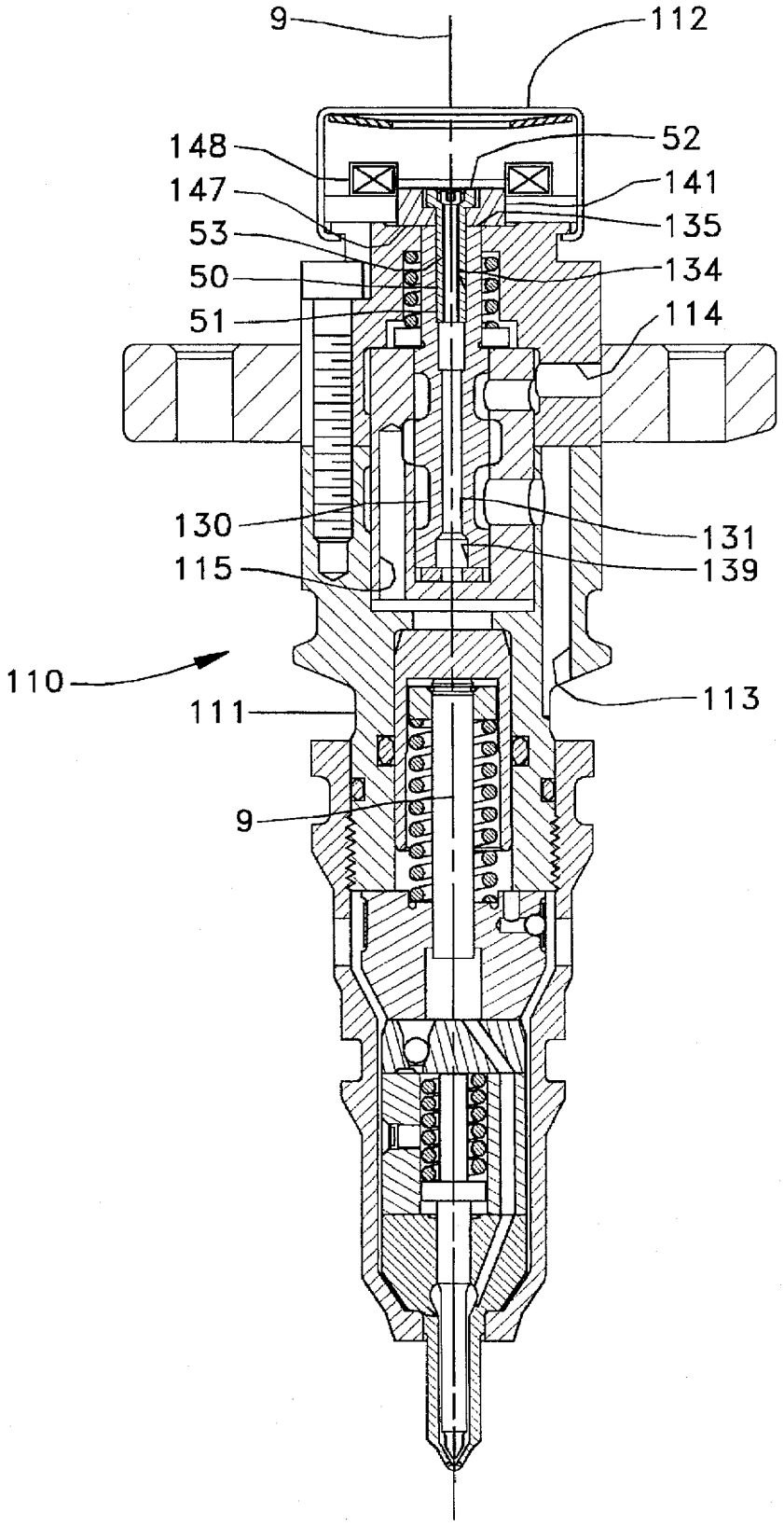
FIG. 9 is a side sectioned elevational view of a HEUI type fuel injector according to another embodiment of the present invention.

Referring now to FIG. 9, an additional embodiment of a fuel injector 110 according to the present invention is illustrated. This injector is substantially similar in all respects to the injector of FIG. 1 except that it includes a spool valve member 130 instead of the poppet valve member of the previous embodiment. However, like the previous embodiment, a vented screw 50 is used to join the armature 141 to the spool valve member 130. The injector 110 includes an injector body 111 that includes a solenoid housing 112 containing an electromagnetic coil 148 that acts upon armature 141 when energized. Like the previous embodiment, injector body 111 includes a high pressure actuation fluid inlet 113 and a low pressure actuation fluid drain 114 that open to an actuation fluid cavity 115 when valve 130 is in an appropriate position. The use of spool valve member 130 permits one to alternatively open inlet 113 or drain 114 or energize the solenoid to a medium state to close both ports. As in the previous embodiment, vented screw 50 includes a vent hole along its length and a threaded rod portion 51 that is mated to threaded opening 134 in valve member 130. The screw serves to hold the lower surface 147 of armature 141 in contact with the top end 135 of spool valve member 130. As in the previous embodiment, fluid displaced by the movement of the armature/valve member assembly is channeled through vented screw 50.

Industrial Applicability

Although the present invention was designed for use with a solenoid actuated valve of a hydraulically actuated electronically controlled fuel injector, the present invention could find potential application in a wide variety of other valving applications. In other words, in any valving application that requires the armature/valve member assembly to displace fluid when it moves between positions, the present invention could be utilized. This is especially important in those applications where available space for a screw joining the armature to the valve member is limited. The present invention could also find applicability in those cases where it is desired to increase the reference surface area utilized in machining high precision valve seats on the outer surface of the valve member. Thus, although the present invention finds particular applicability to fuel injectors, the inventive venting concepts of the present invention could also be successfully incorporated into valving applications in a virtually limitless array of potential applications.

The above description is intended for illustrative purposes only. Those skilled in the art will appreciate that the venting concepts provided by the present invention could be utilized in a wide variety of vented armature/valve member assemblies apart from the fuel injector examples that were illustrated. In any event, the scope of the present invention is not intended to be limited in any way by the illustrated examples described previously but solely in terms of the claims set forth below.

I claim:

1. A vented solenoid armature/valve member assembly comprising:

a body that includes a solenoid housing attached to a valve block;

an armature enclosed in said body and having an upper surface, a lower surface and a screw hole extending through said upper surface and said lower surface;

a valve member enclosed in said body and having an axis, a first end, a second end, an outer surface extending between said first end and said second end, a threaded hole extending through said first end along said axis, an opening through said second end and a hollow interior that opens to said threaded hole and said opening, and said valve member being moveable between a first position and a second position;

a vented screw having a screw axis, a head and a rod portion aligned with said screw axis attached to said head and a vent hole extending through said rod portion and said head along said screw axis;

said rod portion having threads that fit said threaded hole of said valve member; and said vented screw extending through said screw hole of said armature and being threaded into said threaded hole; and said body, said armature and said valve member being shaped and sized such that an amount of fluid surrounding said armature must be displaced toward said hollow interior through said vent hole when said valve member moves from said first position to said second position.

2. The assembly of claim 1 wherein a portion of said vent hole through said head is shaped to receive an internal driving tool.

3. The assembly of claim 2 wherein a portion of said screw hole adjacent said upper surface of said armature is a counter-bore sized to completely receive said head of said vented screw below said upper surface.

4. The assembly of claim 2 wherein said vented screw holds said lower surface of said armature in contact with said first end of said valve member.

5. The assembly of claim 4 wherein said vented screw is made of a material with an elastic range along said axis; and said vented screw is stretched along said axis within said elastic range.

6. The assembly of claim 5 wherein said vented screw is torqued above about three Newton-meters.

7. A solenoid actuated valve assembly comprising:

a solenoid housing;

a valve block with an inside surface defining a cavity, a first port opening to said cavity and a second port opening to said cavity;

said housing being attached to said valve block;

a solenoid having an electromagnetic coil mounted in said solenoid housing and an armature with a screw hole therethrough;

a valve member having an axis, a first end separated from a second end by an outer surface, a threaded hole extending through said first end along said axis, an opening through said second end and a hollow interior that opens to said threaded hole and said opening;

said valve member being positioned in said cavity adjacent said first port and said second port;

a vented screw having a screw axis, a head and a rod portion aligned with said screw axis attached to said head and a vent hole extending through said rod portion and said head along said screw axis:

said rod portion having threads that fit said threaded hole of said valve member;

said vented screw extending through said screw hole of said armature and being threaded into said threaded hole such that said valve member moves with said armature;

said valve member having a first position in which said first port is open to said cavity and said second port is closed to said cavity, and a second position in which said second port is open to said cavity and said first port is closed to said cavity; and said valve member being shaped and sized such that an amount of fluid must be displaced toward said hollow interior through said vent hole when said valve member moves from said first position to said second position.

8. The assembly of claim 7 wherein a portion of said vent hole through said head is shaped to receive an internal driving tool.

9. The assembly of claim 8 wherein a portion of said screw hole adjacent said upper surface of said armature is a counter-bore sized to completely receive said head of said vented screw below said upper surface.

10. The assembly of claim 8 wherein said vented screw holds said lower surface of said armature in contact with said first end of said valve member.

11. The assembly of claim 10 wherein said vented screw is made of a material with an elastic range along said screw axis; and said vented screw is stretched along said screw axis within said elastic range.

12. The assembly of claim 11 wherein said vented screw is torqued above about three Newton-meters.

13. A hydraulically actuated fuel injector comprising:

an injector body having an actuation fluid cavity that opens to an actuation fluid inlet, an actuation fluid drain and a piston bore, and having a plunger bore that opens to a nozzle supply bore and a fuel supply passage, and also having a nozzle chamber that opens to said nozzle supply bore and a nozzle outlet;

an intensifier piston positioned to reciprocate in said piston bore between an upper position and a lower position;

a plunger having a side surface extending between a contact end and a pressure face end and being positioned to reciprocate in said plunger bore between an advanced position and a return position;

a portion of said plunger bore and said pressure face end of said plunger defining a fuel pressurization chamber;

a one way valve positioned in said fuel supply passage and being operable to prevent fluid flow into said fuel supply passage from said fuel pressurization chamber;

a needle check positioned to reciprocate in said nozzle chamber between a closed position that closes said nozzle outlet and an open position that opens said nozzle outlet, said needle check including a hydraulic lift surface exposed to said nozzle chamber;

means, within said injector body, for biasing said needle check toward said closed position;

a solenoid having an electromagnetic coil and an armature attached to said injector body;

said armature having an upper surface, a lower surface and a screw hole extending through said upper surface and said lower surface;

a valve member positioned in said actuation fluid cavity and having an axis, a first end, a second end, an outer surface extending between said first end and said second end, a threaded hole extending through said first end along said axis, an opening through said second end and a hollow interior that opens to said threaded hole and said opening;

a vented screw having a screw axis, a head and a rod portion aligned with said screw axis attached to said head and a vent hole extending through said rod portion and said head along said screw axis;

said rod portion having threads that fit said threaded hole of said valve member;

said vented screw extending through said screw hole of said armature and being threaded into said threaded hole such that said valve member moves with said armature;

said valve member having a first position in which said actuation fluid inlet is open to said actuation fluid cavity, but said outer surface closes said actuation fluid drain to said actuation fluid cavity, and having a second position in which said actuation fluid drain is open to said actuation fluid cavity, but said outer surface closes said actuation fluid inlet to said actuation fluid cavity; and said valve member being shared and sized such that an amount of fluid must be dispaced toward said hollow interior through said vent hole when said valve member moves from said second position to said first position.

14. The injector of claim 13 wherein a portion of said vent hole through said head is shaped to receive an internal driving tool.

15. The injector of claim 14 wherein a portion of said screw hole adjacent said upper surface of said armature is a counter-bore sized to completely receive said head of said vented screw below said upper surface.

16. The injector of claim 14 wherein said vented screw holds said lower surface of said armature in contact with said first end of said valve member.

17. The injector of claim 16 wherein said vented screw is made of a material with an elastic range along said screw axis; and said vented screw is stretched along said screw axis within said elastic range.

18. The injector of claim 17 wherein said vented screw is torqued above about three Newton-meters.

19. The injector of claim 13 wherein said valve member is a spool valve member having a third position in which both said actuation fluid inlet and said actuation fluid drain are closed to said actuation fluid cavity.

20. The injector of claim 13 wherein said valve member is a poppet valve member.

* * * * *

UNITED STATES PATENT AND TRADEMARK OFFICE

CERTIFICATE OF CORRECTION

PATENT NO. : 5,709,342

DATED : January 20, 1998

INVENTOR(S) : David B. McCauley

It is certified that error appears in the above-identified patent and that said Letters Patent is hereby corrected as shown below:

Please correct Claim 13 as follows:

Column 10, line 47, delete "shared" and insert --shaped--

Column 10, line 48, delete "dispaced" and insert --displaced--

Signed and Sealed this

Twenty-eighth Day of April, 1998

Bruce Lehman

*Attest:*

BRUCE LEHMAN

*Attesting Officer*

*Commissioner of Patents and Trademarks*